United States Patent [19]

Aoki et al.

[11] 4,239,851

[45] Dec. 16, 1980

[54] SILVER HALIDE PHOTOGRAPHIC LIGHT-SENSITIVE MATERIAL

[75] Inventors: Kozo Aoki; Yukio Yokota, both of Minami-ashigara, Japan

[73] Assignee: Fuji Photo Film Co., Ltd., Minami-ashigara, Japan

[21] Appl. No.: 8,442

[22] Filed: Feb. 1, 1979

[30] Foreign Application Priority Data

Feb. 2, 1978 [JP] Japan ..... 53/10684

[51] Int. Cl.[3] ..... G03C 5/50; G03C 1/40

[52] U.S. Cl. ..... 430/377; 430/384; 430/385; 430/546; 430/552; 430/553

[58] Field of Search ..... 96/100, 97, 114, 114.4; 430/377, 546, 552, 553, 384, 385

[56] References Cited

U.S. PATENT DOCUMENTS

| | | | |
|---|---|---|---|
| 3,047,394 | 7/1962 | Allen et al. | 96/114 X |
| 3,062,674 | 11/1962 | Houck et al. | 96/114 X |
| 3,091,537 | 5/1963 | Burness | 96/114 X |
| 3,158,484 | 11/1964 | Willems et al. | 96/114 X |
| 3,189,459 | 6/1965 | Burness | 96/114 X |
| 3,632,373 | 1/1972 | O'Connell et al. | 96/100 X |
| 3,746,545 | 7/1973 | Pollett et al. | 96/114 X |
| 3,839,047 | 10/1974 | Suga et al. | 96/114 |
| 3,989,529 | 11/1976 | Viro et al. | 96/114.4 X |

OTHER PUBLICATIONS

T. W. Findlay, J.A.C.S., 67, 412, (1945) et al.

R. J. Gall, et al.; Ind. Eng. Chem., 47, 147 (1955).

F. P. Greenspan et al., J. Am. Oil Chem. Soc., 33 391 (1956).

R. M. Brice et al., Ind. Eng. Chem. 50, 868, 871, 873 (1958).

*Primary Examiner*—J. Travis Brown

*Attorney, Agent, or Firm*—Sughrue, Rothwell, Mion, Zinn and Macpeak

[57] ABSTRACT

A silver halide photographic light-sensitive material and a process for preparing the same are disclosed wherein an oil-soluble photographic additive and, in particular, a cyan coupler is dissolved in an epoxy compound of the formula (I):

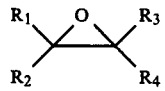

(I)

wherein $R_1$, $R_2$, $R_3$ and $R_4$ each represents an alkyl group or substituted alkyl group containing 1 to 40 carbon atoms, an alkoxycarbonyl group or substituted alkoxycarbonyl group containing 1 to 40 carbon atoms, or a hydrogen atom, provided that $R_1$, $R_2$, $R_3$ and $R_4$ do not represent hydrogen atoms at the same time and that the sum of the number of carbon atoms of $R_1$, $R_2$, $R_3$ and $R_4$ is 8 to 60, and $R_1$, $R_2$, $R_3$ and $R_4$ may be the same or different and may combine to form a ring; or in an epoxy compound formed by linking two compounds of said formula (I) which may be the same or different through any of $R_1$ to $R_4$ or the ring formed by $R_1$ to $R_4$.

11 Claims, No Drawings

SILVER HALIDE PHOTOGRAPHIC LIGHT-SENSITIVE MATERIAL

BACKGROUND OF THE INVENTION

1. Field of the Invention

The present invention relates to a silver halide photographic light-sensitive material and, more particularly, it relates to a silver halide photographic light-sensitive material containing oil-soluble photographic additives dispersed in a hydrophilic organic colloid layer using an epoxy compound or compounds.

2. Description of the Prior Art

Oil-soluble photographic additives (for example, oil-soluble couplers, antioxidants for preventing color fog or color mixing, fading-preventing agents (e.g., alkylhydroquinones, alkylphenols, chromans, coumarones, etc.), hardening agents, oil-soluble filter dyes, oil-soluble U.V. absorbing agents, DIR compounds (e.g., DIR hydroquinones, uncolored DIR compounds, etc.), developing agents, color developers, and DRR compounds (e.g., DDR couplers, etc.)) have heretofore been used by dissolving them in a suitable high-boiling organic solvent, dispersing the solution in a hydrophilic organic colloid, in particular, a gelatin solution, in the presence of a surface active agent and incorporating them into a hydrophilic organic colloid layer (e.g., a light-sensitive emulsion layer, a filter layer, a backing layer, an antihalation layer, an interlayer, a protective layer, etc.). As the high-boiling organic solvent, phthalic ester compounds and phosphoric ester compounds are particularly used.

In particular, most of the solvents for photographic additives (e.g., oil-soluble incorporated type couplers) used in the manufacture of color and black-and-white photographic light-sensitive materials are of these types. Examples thereof are described in U.S. Pat. Nos. 2,322,027, 2,533,514, 3,287,134, 3,748,141, 3,779,765, West German Pat. No. 1,152,610, British Pat. No. 1,272,561, West German Patent Application (OLS) No. 2,629,842, etc. The high boiling solvents of phthalic ester compounds and phosphoric ester compounds have often been used for their coupler-dispersing ability, their affinity for the gelatin colloid layer, their influence on the stability of colored images, their influence on the hue of colored images, their chemical stability in a light-sensitive material, their inexpensiveness, their availability, etc.

However, such high boiling organic solvents are not totally satisfactory from the standpoint of their ability to disperse oil-soluble photographic additives, their affinity for a hydrophilic organic colloid layer, their influence on photographic properties, their chemical stability in a light-sensitive material, and the like. For example, some high boiling organic solvents exert detrimental influences on the photographic properties (e.g., on the stability of the color images obtained by dispersing a photographic coupler, and on the development-processing of a coupler-containing light-sensitive material), although some exhibit good photographic additive dispersing property, and some have reverse properties.

In particular, there have been no high boiling organic solvents for oil-soluble photographic additives which provide a good, fast cyan color image resistant to heat and humidity and show good dispersing property.

SUMMARY OF THE INVENTION

A principal object of the present invention is to provide a color light-sensitive material, wherein an oilsoluble cyan coupler is dispersed in a stable state in a hydrophilic colloid.

Another object of the present invention is to provide color images with high fastness to heat and humidity.

Still a further object of the present invention is to provide a means for dispersing oil-soluble photographic additives in general into a hydrophilic colloid.

A further object of the present invention is to provide a high boiling solvent for oil-soluble photographic additives including oil-soluble cyan couplers which can be used alone or in combination with the high boiling organic solvents conventionally used for this purpose.

A still further object of the present invention is to provide a high boiling solvent with good dispersing ability which does not interfere with the formation of a fast image.

These and other objects have been attained by dissolving a coupler capable of oxidatively coupling with a developing agent to form a cyan color image in an epoxy compound represented by general formula (I) or in an epoxy compound wherein two compounds of the formula (I) which may be the same or different are linked together at the $R_1$ to $R_4$ groups or the rings formed thereby, and dispersing it in a hydrophilic organic colloid:

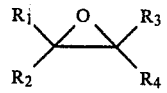

(I)

In the above formula, $R_1$, $R_2$, $R_3$ and $R_4$ each represents a straight chain, branched chain or cyclic alkyl group having 1 to 40 carbon atoms (for example, butyl, octyl, dodecyl, isostearyl, cyclohexyl, etc.); a substituted alkyl group containing 1 to 40 carbon atoms (including the substituents), wherein the alkyl moiety is a straight chain, branched chain or cyclic alkyl group and the substituent is an alkoxycarbonyl group having 2 to 23 carbon atoms (for example, butyloxycarbonyl, 2-ethylhexyloxycarbonyl, dodecyloxycarbonyl, hexadecyloxycarbonyl, cyclohexyloxycarbonyl, etc.), an alkylcarbonyloxy group having 2 to 23 carbon atoms (for example, acetoxy, pivaloyloxy, dodecylcarbonyloxy, hexadecylcarbonyloxy, etc.), an arylcarbonyloxy group having 7 to 23 carbon atoms (for example, benzoyloxy, p-methylbenzoyloxy, m-nitrobenzoyloxy, 2,4-dichlorobenzoyloxy, etc.), an alkoxy group having 1 to 22 carbon atoms (for example, ethyloxy, 2-methoxyethoxy, dodecyloxy, etc.) or an aryloxy group having 6 to 22 carbon atoms (for example, phenoxy, p-methoxyphenoxy, 2,4-di-t-butylphenoxy, m-pentadecylphenoxy, etc.); an alkoxycarbonyl group containing 1 to 40 carbon atoms wherein the alkoxy moiety is a straight chain, branched chain or cyclic alkoxy group (for example, butyloxycarbonyl, 2-ethylhexyloxycarbonyl, decyloxycarbonyl, hexadecyloxycarbonyl, cyclohexyloxycarbonyl, etc.); a substituted alkoxycarbonyl group having 1 to 40 carbon atoms (including substituents) wherein the alkoxy moiety is a straight chain, branched chain or cyclic alkoxy group and the substituent is the same as described above for the alkyl group; or a hydrogen atom; provided that all of $R_1$, $R_2$, $R_3$ and $R_4$ do not represent hydrogen atoms at the same time and the sum of the number of carbon atoms of $R_1$, $R_2$, $R_3$ and $R_4$ is 8 to 60, preferably 8 to 45. Further, $R_1$, $R_2$, $R_3$ and $R_4$ may be the same or different from each other and may form a ring. The ring may be a 5- or 6-membered ring (for example, cyclohexane, cycloheptane) and substituted with a carboxylic acid ester group (for example, a butyloxycarbonyl group, an octyloxycarbonyl group, a hexadecyloxycarbonyl group, etc.) or an alkyl group (for example, an ethyl group, etc.). The R groups forming the ring may be on the same or different carbon atoms.

Of the compounds represented by the general formula (I), particularly preferable compounds are those represented by the general formula (II):

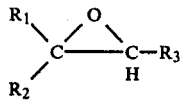

(II)

wherein $R_1$, $R_2$ and $R_3$ are the same as defined in the general formula (I), provided that at least one of $R_1$, $R_2$ and $R_3$ is an alkyl group substituted by an alkoxycarbonyl group, an aryloxycarbonyl group or an aryloxy group having 8 to 40 carbon atoms (including carbon atoms of the substituents) and the sum of the number of carbon atoms of $R_1$, $R_2$ and $R_3$ is 8 to 60, preferably 8 to 45. Further, $R_1$ and $R_3$ may combine to form a ring as defined above.

Specific examples of the epoxy compounds to be used in the present invention are illustrated below, which, however, are only illustrative and are not intended to limit the present invention.

Compound 1

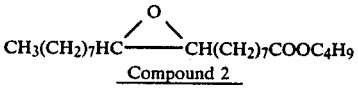

Compound 2

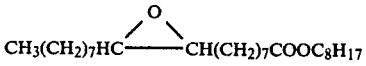

Compound 3

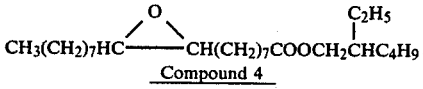

Compound 4

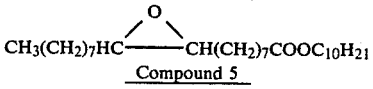

Compound 5

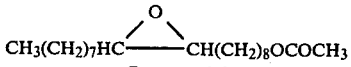

Compound 6

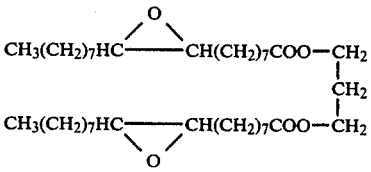

Compound 7

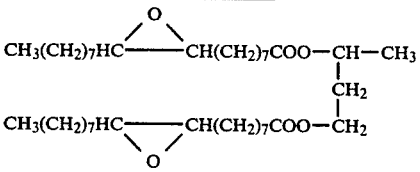

Compound 8

-continued

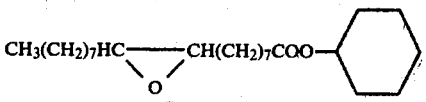

Compound 9

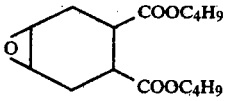

Compound 10

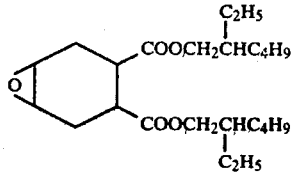

Compound 11

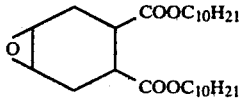

Compound 12

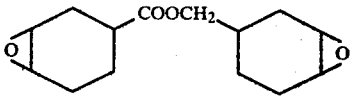

Compound 13

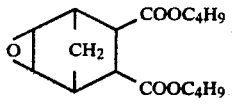

Compound 14

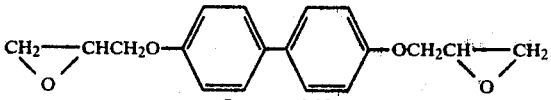

Compound 15

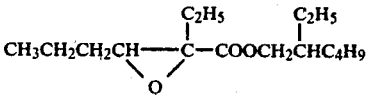

Compound 16

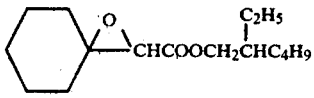

Compound 17

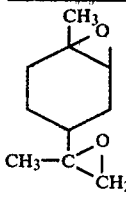

Compound 18

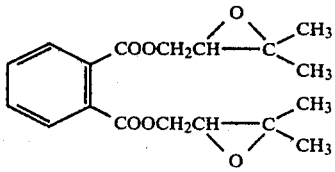

As the cyan couplers to be used in the present invention, any so-called oil-soluble cyan coupler can be used. Examples thereof will be described below.

As the cyan couplers, phenolic compounds, naphtholic compounds, etc., can be used. Specific examples thereof are oil-soluble couplers selected from those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, West German Patent Application (OLS) Nos. 2,414,830, 2,454,329, Japanese Patent Application (OPI) NOs. 59838/73 (The term "OPI" as used herein refers to a "published unexamined Japanese patent application"), 26034/76, 5055/73, 146828/76, U.S. Pat. No. 4,004,929, etc.

Further, of the cyan color image-forming couplers, it is particularly advantageous to use those represented by the following general formula (III) since they are particularly remarkably improved in dye fastness.

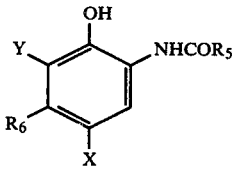

(III)

In the above formula, $R_5$ represents a straight chain, branched chain or cyclic alkyl group having 1 to 22 carbon atoms (for example, ethyl, butyl, dodecyl, isostearyl, cyclohexyl, etc.); a substituted alkyl group wherein the alkyl moiety is a straight chain, branched chain or cyclic alkyl group having 1 to 22 carbon atoms and the substituent is a halogen atom, an ether group, an acylamino group, a carbamoyl group, a sulfonamide group or a sulfamoyl group (for example, trichloromethyl, heptafluoropropyl, 1(2',4'-di-t-pentylphenoxy)-propyl, 4-decanoylaminophenoxymethyl, 1-(4-hexadecanesulfonylaminophenoxy)propyl, 3-(m-pentadecylphenoxy)propyl, etc.); or a substituted or unsubstituted aryl group having 6 to 22 carbon atoms wherein the substituent may be a halogen atom or an aryloxy group (for example, phenyl, p-chlorophenyl, p-phenoxyphenyl, etc.). $R_6$ represents a straight chain or branched chain alkyl group having 1 to 22 carbon atoms (for example, methyl, ethyl, isopropyl, t-butyl, pentadecyl, etc.); a substituted alkyl group wherein the alkyl moiety is a straight chain or branched chain alkyl group having 1 to 22 carbon atoms and the substituent is a halogen atom, an ether group or a thioether group (for example, chloromethyl, ethoxymethyl, p-chlorophenylthiomethyl, etc.); an acylamino group represented by the formula $R_5CONH$- group (in this case, the $R_6$ group and the $R_5CONH$- group may be the same or different from each other); or a hydrogen atom. It is necessary that at least one of $R_5$ and $R_6$ represents a so-called ballast group containing 10 to 22 carbon atoms. X represents a group capable of being eliminated upon oxidative coupling with a developing agent (a so-called coupling-off group). The coupling-off group determines the equivalency of the coupler (that is, whether the coupler is two-equivalent coupler or fourequivalent coupler). Further, the coupling-off group can improve the reactivity of the coupler, inhibit development and accelerate bleaching. Representative examples of X include a hydrogen atom, a halogen atom, an alkoxy group, an aryloxy group, an arylazo group, a thioether group and a heterocyclic ring such as an oxazolyl, a diazolyl, a triazolyl or a tetrazolyl ring. The most preferred coupling-off groups for X are a hydrogen atom and a halogen atom (for example, chlorine, fluorine, bromine, etc.). Y represents a hydrogen atom or a halogen atom (for example, fluorine, chlorine, bromine, iodine, etc.).

As the cyan couplers used in accordance with the present invention there are, for example, also those described in U.S. Pat. Nos. 2,367,531, 2,423,452, 3,222,176, 3,647,452, 3,652,286, 3,737,318, 3,758,308, 3,779,763, 3,864,366, 3,998,642, 4,009,035, etc.

Specific examples of the cyan couplers to be used in the present invention will be illustrated below, which are offered only for illustration. The present invention is not limited to these uses alone.

Coupler 1

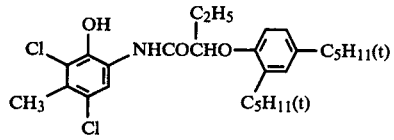

Coupler 2

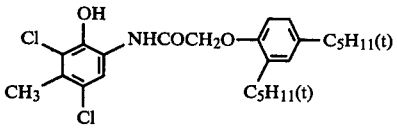

Coupler 3

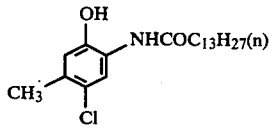

Coupler 4

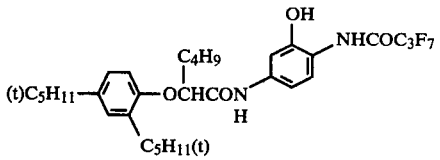

Coupler 5

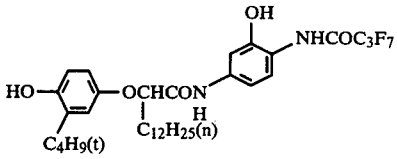

Coupler 6

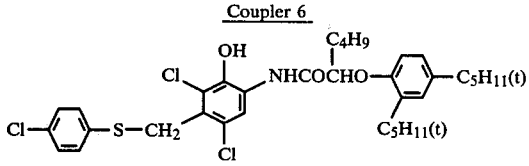

Coupler 7

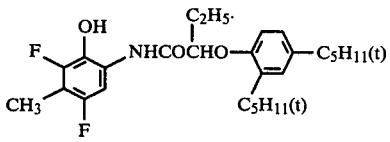

The epoxy compounds to be used in the present invention are characterized by their boiling point which are higher than 200° C. under atmospheric pressure.

The epoxy compounds of the general formula (I) to be used in the present invention can generally be obtained by oxidizing an olefinic double bond with hydrogen peroxide as described in T. W. Findlay et al., *J. Amer. Chem. Soc.*, 67, 412 (1945); R. J. Gall et al., *Ind. Eng. Chem.*, 47, 147 (1955); U.S. Pat. No. 2,485,160; F.

P. Greenspan et al., *J. Amer. Oil Chem. Soc.*, 33, 391 (1956); and R. M. Brice et al., *Ind. Eng. Chem.*, 50, 868, 871 and 873 (1958). In general, such epoxy compounds are commercially available as plasticizers for polymers and show particularly excellent properties when used as a high boiling organic solvent in photographic lightsensitive materials. Examples of commercially available epoxy compounds are: Unox 201 (Compound 12) and Unox 269 (Compound 17) which are products of Union Carbide Corp.; Sansosizer E-4030 (Compound 1) and Sansosizer EPE (Compound 11) which are products of New Japan Chemical Co., Ltd.; and Newsizer 540 (Compound 1), Newsizer 560 (Compound 2) and Newsizer 580 (Compound 4) which are products of Nippon Oils & Fats Co., Ltd.

The epoxy compounds of the general formula (I) may be used independently as a high boiling organic solvent by dissolving therein the oil-soluble photographic additives or may be used in combination with other known high boiling organic solvents.

The amount (weight ratio) of epoxy compounds represented by the general formula (I) to be used is about 0.05 to 20, preferably about 0.1 to 10, based on the amount of epoxy compound to the amount of oil-soluble photographic additive and/or cyan coupler.

As the oil-soluble photographic additives other than the cyan coupler which can be advantageously mixed in accordance with the present invention, there are all photographic additives which have so far been dispersed in a hydrophilic organic colloid layer using known high boiling organic solvents. As the typical oil-soluble photographic additives, there are illustrated: oil-soluble photographic yellow couplers, oil-soluble photographic magenta couplers, antioxidants and color fade-preventing agents capable of preventing color fog or fading of colored images (e.g., alkylhydroquinones, alkylphenols, chromans, coumarones, phosphites, etc.), hardeners, oil-soluble filter dyes capable of selectively absorbing visible light or ultraviolet rays, oil-soluble ultraviolet ray-absorbing agents, fluorescent brightening agents, DIR compounds (e.g., DIR hydroquinones, DIR coupling compounds, etc.), developing agents, DIR couplers, DRR compounds, color developers, etc.

As stated above, the high boiling epoxy compound solvents to be used in the present invention can exhibit the same properties as a conventional high boiling organic solvents when used alone and, in addition, they can be used together with other known high boiling solvents for photographic additives. As such known high boiling organic solvents, there are illustrated, for example, those described in U.S. Pat. Nos. 2,322,037, 2,533,514, 2,835,579, Japanese Patent Publication No. 23233/71, U.S. Pat. No. 3,287,134, British Pat. No. 958,441, Belgian Pat. No. 768,585, British Pat. Nos. 1,222,753 and 1,501,233, U.S. Pat. No. 3,936,303, Japanese Patent Application (OPI) Nos. 26037/76 and 82078/75, U.S. Pat. Nos. 2,353,262, 2,852,383, 3,554,755, 3,676,137, 3,767,142, 3,700,454, 3,748,141, 3,837,863 and 4,004,928, German Patent Applicatio (OLS) No. 2,538,889, Japanese Patent Application (OPI) No. 27921/76, Japanese Patent Publication Nos. 28693/77 and 29461/74, U.S. Pat. Nos. 3,936,303 and 3,748,141 etc. As the high boiling organic solvents which can be used more preferably, there are illustrated esters (e.g., phthalic acid esters, phosphoric acid esters, citric acid esters, benzoic acid esters, fatty acid esters, carbonic acid esters, etc.), amides (e.g., fatty acid amides, sulfonamides, etc.), ethers (e.g., allyl ethers, etc.), alcohols, paraffins, etc. Particularly preferable high boiling organic solvents are, for example, phthalic esters (e.g., dibutyl phthalate, dihexyl phthalate, diheptyl phthalate, dioctyl phthalate, dinonyl phthalate, didecyl phthalate, butylphthalylbutyl glycolate, dibutyl monochlorophthalate, etc.), phosphoric acid esters (e.g., tricresyl phosphate, trixylenyl phosphate, tris(isopropylphenyl) phosphate, tributyl phosphate, trihexyl phosphate, trioctyl phosphate, trinonyl phosphate, tridecyl phosphate, trioleyl phosphate, tris(butoxyethyl) phosphate, tris(chloroethyl) phosphate, tris(dichloropropyl) phosphate, etc.), citric acid esters (e.g., o-acetyltriethyl(or butyl, hexyl, octyl, nonyl or decyl) citrate, etc.), benzoic acid esters (e.g., butyl (or hexyl, heptyl, oxtyl, nonyl, decyl, dodecyl, tridecyl, tetradecyl, hexadecyl, octadecyl, oleyl, etc.) benzoate, pentyl o-methylbenzoate, decyl p-methylbenzoate, octyl o-chlorobenzoate, lauryl p-chlorobenzoate, propyl 2,4-dichlorobenzoate, octyl 2,4-dichlorobenzoate, stearyl 2,4-dichlorobenzoate, oleyl 2,4-dichlorobenzoate, octyl p-methoxybenzoate, etc.), fatty acid esters (e.g., hexadecyl myristate, dibutoxyethyl succinate, dioctyl adipate, dioctyl azelate, decamethylene-1,10-diol diacetate, triacetin, tributyrin, benzyl caprate, pentaerythritol tetracapronate, isosorbide dicaprylate, etc.), amides (e.g., N,N-dimethyllauroamide, N,N-diethylcaprylamide, N-butylbenzenesulfonamide, etc.), trioctyl trimellitate, chlorinated paraffin, etc.

The epoxy compounds of the present invention may be used together with substantially water-insoluble low boiling auxiliary solvents (e.g., methyl acetate, ethyl acetate, butyl acetate, etc.), or water-soluble organic auxiliary solvents (e.g., methyl isobutyl ketone, $\beta$-ethoxyethyl acetate, methyl carbitol, methyl cellosolve, dipropylene glycol dimethylformamide, dioxane, etc.). Such low boiling auxiliary solvents are described in, for example, U.S. Pat. Nos. 2,801,170, 2,801,171, 2,949,360 and 3,835,579. These auxiliary solvents may be removed by washing with water as described in U.S. Pat. Nos. 2,801,171, 2,949,360 and 3,396,027, or may be removed by vaporizing as described in U.S. Pat. Nos. 2,322,027, 2,801,171, West German Patent Application (OLS) No. 2,045,464, etc.

The epoxy compounds of the present invention are used alone or in combinations of two or more compounds, and photographic additives such as couplers, antioxidants, filter dyes, etc., are dissolved therein, followed by dispersing the solution in an aqueous solution of hydrophilic colloid (in particular, gelatin). In this case, it is particularly preferable to use a single epoxy compound or a mixture of epoxy compounds in further combination with an auxiliary solvent.

The method of dispersion is described in, for example, U.S. Pat. Nos. 2,304,939, 2,322,027, 2,801,170, 2,801,171, 2,949,360, etc.

As the dispersing aids, usually employed are anionic surface active agents (e.g., sodium alkylbenzenesulfonate, sodium dioctylsulfosuccinate, sodium dodecylsulfate, sodium alkylnaphthalenesulfonate, Fischer type couplers, etc.), amphoteric surface active agents (e.g., N-tetradecyl-N,N-dipolyethylene-$\alpha$-betaine, etc.) and nonionic surface active agents (e.g., sorbitan monolaurate, etc.).

The hydrophilic organic colloid layer in accordance with the present invention is a photographic layer using, as a binder, a hydrophilic organic colloid (for example, gelatin (very often used), cellulose derivatives, alginates, hydrophilic synthetic polymers (e.g., polyvinyl alcohol, polyvinyl pyrrolidone, polystyrenesulfonic acid, styrenesulfonic acid copolymers, maleic acid copolymers, acrylic acid copolymers, methacrylic acid copolymers, itaconic acid copolymers, etc.), modified gelatin (e.g., phthaloylated gelatin, etc.), and the like; these hydrophilic organic colloids other than gelatin are used alone or in combination of two or more, but they are usually used in combination with gelatin). To such hydrophilic organic colloid layers are added, in some cases, a polymer latex (e.g., polymethyl methacrylate latex, polyethyl acrylate latex, etc.) in order to improve the physical properties of the photographic layers and make the emulsion particles finer.

As the hydrophilic organic colloid layer, there are illustrated silver halide photographic light-sensitive layers and non-light-sensitive photographic auxiliary layers (e.g., a protective layer, interlayer, filter layer, anti-irradiation layer, antihalation layer, backing layer, development stain-preventing layer, barrier layer, etc.).

The present invention will now be illustrated in more detail by reference to the following Examples. Unless otherwise indicated, all parts, percents, ratios, etc., are by weight.

EXAMPLE 1

A solution prepared by heating 19.1 g of cyan coupler, 2-[α-(2,4-di-t-amylphenoxy)butanamido]-4,6-dichloro-5-methylphenol, 19 g of Compound 10 of the present invention and 40 ml of ethyl acetate to 70° C. was added to 250 ml of an aqueous solution containing 25 g of gelatin and 1.5 g of sodium dodecylbenzenesulfonate, and stirred. Then, the mixture was passed 5 times, after pre-heating, through a colloid mill. As a result, the coupler was finely emulsified and dispersed together with the solvent.

The emulsion dispersion was added to 1.0 kg of a photographic emulsion containing 54 g of silver bromoiodide emulsion and 60 g of gelatin and, after adding 30 ml of a 5% acetone solution of triethylenephosphamide as a hardener, the pH of the mixture was adjusted to 6.0, followed by coating on a cellulose triacetate film base in a dry thickness of 7.0μ. Thus, there was prepared Sample A.

In the same manner as described above except using Compounds 1, 3 or 11 in place of Compound 10 in the same amount, there were prepared film Samples B, C and D. For the purpose of comparison, film Sample E was prepared in the same manner as above except using dibutyl phthalate (DBP) in place of Compound 10 in the same amount.

These samples were subjected to stepwise exposure for sensitometry, then the following processings were carried out.

| Color Development Processing Step | | |
|---|---|---|
| 1. Color Development | 30° C. | 4 min |
| 2. Bleach-Fixing | " | 2 min |
| 3. Washing with Water | " | 2 min |
| 4. Stabilizing Bath | " | 2 min |

Compositions of the respective processing solutions in the color development steps are as follows:

| Color Developer | |
|---|---|
| Sodium Metaborate | 25 g |
| Sodium Sulfite | 2 g |
| Hydroxylamine (sulfate) | 2 g |

-continued

| | |
|---|---|
| Potassium Bromide | 0.5 g |
| 6-Nitrobenzimidazole (borate) | 0.02 g |
| Sodium Hydroxide | 4 g |
| Benzyl Alcohol | 15.8 ml |
| Diethylene Glycol | 20 ml |
| 4-(N-Ethyl-N-β-methanesulfonamidoethyl)-amino-2-methylaniline Sesquisulfate | 8 g |
| Water to make | 1 l (pH: 10.2) |
| **Bleach-Fixing Solution** | |
| Fe (II) Ethylenediaminetetraacetate | 45 g |
| Ammonium Thiocyanate | 10 g |
| Sodium Sulfite | 10 g |
| Ammonium Thiosulfate (60 wt % aq. soln.) | 100 ml |
| Sodium Ethylenediaminetetraacetate | 5 g |
| Water to make | 1 l (pH: 6.9) |
| **Stabilizing Bath** | |
| Tartaric Acid | 10 g |
| Zinc Sulfate | 10 g |
| Sodium Metaborate | 20 g |
| Water to make | 1 l |

Moist heat stability tests were conducted on the thus-developed film samples. The fastness of the samples after 1 week at 100° C. and the fastness after 6 weeks at 60° C. and 75% RH are indicated in Table 1 in terms of % reduced density based on the initial density.

TABLE 1

| | | 100° C., 1 Week | | 60° C., 75% RH, 6 Weeks | |
|---|---|---|---|---|---|
| Sample | Compound | $D_{0.5}$ (%) | $D_{1.5}$ (%) | $D_{0.5}$ (%) | $D_{1.5}$ (%) |
| A | 10 | 34 | 38 | 7 | 9 |
| B | 1 | 41 | 42 | 12 | [illegible] |
| C | 3 | 38 | 42 | 11 | 14 |
| D | 11 | 35 | 40 | 8 | 11 |
| E | DBP | 60 | 65 | 19 | 21 |

The greater the reduction in density, the poorer is the fastness.

As is clear from Table 1, Sample E wherein the coupler was dispersed using DBP suffered serious fading of color images under humidity, whereas Samples A to D of the present invention suffered remarkably less color fading.

EXAMPLE 2

Sample F was prepared in the same manner as in Example 1 except for using 9.5 g of Compound 10 and 9.5 g of DBP in place of 19 g of Compound 10, and a humidity test was conducted simultaneously with Sample E of Example 1 in the same manner as in Example 1 to obtain the results shown in Table 2 below.

TABLE 2

| | | 100° C., 1 Week | | 60° C., 75% RH, 6 Weeks | |
|---|---|---|---|---|---|
| Sample | Compound | $D_{0.5}$ (%) | $D_{1.5}$ (%) | $D_{0.5}$ (%) | $D_{1.5}$ (%) |
| F | 10 + DBP | 45 | 48 | 10 | 14 |
| E | DBP | 62 | 68 | 18 | 21 |

The above results show that the epoxy compound of the present invention can remarkably improve resistance to moist heat fading even when used together with another high boiling organic solvent.

EXAMPLE 3

On a paper support laminated with polyethylene on both sides were coated the following first layer (lowermost layer) to the sixth layer (uppermost layer) to prepare a multilayer color light-sensitive material (Sample G). In the table "mg/m²" represents the coated amount.

| | | |
|---|---|---|
| 6th layer (protective layer): | Gelatin: | 1,500 mg/m² |
| 5th layer (red-sensitive layer): 50 mol %; | Silver chlorobromide emulsion (AgBr: silver: 300 mg/m²) | |
| | Gelatin: | 1,500 mg/m² |
| | Cyan coupler (*1): | 500 mg/m² |
| | Coupler solvent (*2): | 250 mg/m² |
| 4th layer (UV ray-absorbing layer): | Gelatin: | 1,200 mg/m² |
| | UV ray-absorbing agent (*3): | 1,000 mg/m² |
| | Solvent for UV absorbing agent (*2): | 250 mg/m² |
| 3rd layer (green-sensitive layer): 50 mol %; | Silver chlorobromide emulsion (AgBr: Ag: 450 mg/m²) | |
| | Gelatin: | 1,500 mg/m² |
| | Magenta coupler (*4): | 400 mg/m² |
| | Coupler solvent (*5): | 200 mg/m² |
| 2nd layer: | Gelatin: | 1,000 mg/m² |
| 1st layer (blue-sensitive layer): 80 mol %; | Silver bromochloride emulsion (AgBr: Ag: 450 mg/m²) | |
| | Gelatin: | 1,500 mg/m² |
| | Yellow coupler (*6): | 500 mg/m² |
| | Coupler solvent (*7): | 500 mg/m² |
| Support: | Polyethylene laminated paper | |
| *1 Cyan coupler: | 2-[α-(2,4-di-t-amylphenoxy) butanamido]-4, 6-dichloro-5-methylphenol | |
| *2 Coupler solvent: | di-n-butyl phthalate | |
| *3 UV ray-absorbing agent: | 2-(2-hydroxy-3-sec-butyl-5-t-butyl-phenyl)benzotriazole | |
| *4 Magenta coupler: | 1-(2,4,6-trichlorophenyl)-3-[2-chloro-5-tetradecanamido]anilino-2-pyrazolin-5-one | |
| *5 Coupler solvent: | o-cresyl phosphate | |
| *6 Yellow coupler: | α-pivaloyl-α-[2,4-dioxo-5, 5'-dimethyl-oxazolidin-3-yl]-2-chloro-5-[α-2,4-di-t-amylphenoxy)butanamido] acetanilide | α-2,4-di-t- |
| *7 Coupler solvent: | o-dioctylbutyl phosphate | |

Sample H was prepared wherein the coupler solvent in the 5th layer of above-described Sample G was replaced by Compound 10 of the present invention. In Sample H, too, the ratio of the weight of cyan coupler to the coupler solvent was adjusted to 2:1 which was the same as with comparative Sample G.

Each sample was exposed for ½ second to blue light, green light and red light through a continuous wedge, then subjected to the following processings:

| Step | Time | Temperature (°C.) |
|---|---|---|
| 1. Color Development | 3 min 30 sec | 33 |
| 2. Bleach-Fixing | 1 min 30 sec | 33 |
| 3. Washing with Water | 2 min | 33 |
| 4. Drying | | |
| Composition of the Developer | | |
| Benzyl Alcohol | | 15 ml |

-continued

| Step | Time | Temperature (°C.) |
|---|---|---|
| Sodium Sulfite | | 5 g |
| Potassium Bromide | | 0.5 g |
| Hydroxylamine Sulfate | | 2.0 g |
| Sodium Carbonate | | 30.0 g |
| Sodium Nitrilotriacetate | | 2.0 g |
| 4-Amino-3-methyl-N-(β-methanesulfonamido)-ethylaniline | | 5.0 g |
| Water to make | | 1,000 ml (pH: 10.1) |
| Composition of Bleach-Fixing Solution | | |
| Ammonium Thiosulfate | | 105 g |
| Sodium Sulfite | | 2 g |
| EDTA Disodium Salt | | 40 g |
| Sodium Carbonate ($H_2O$) | | 5 g |
| Water to make | | 1,000 ml (pH: 7.0) |

When the resulting samples were left for 1 week in a dark room at 100° C., and when left for 6 weeks in a dark room at 60° C. and 75% RH, reductions in cyan color image density based on the initial density thereof were as tabulated in Table 3. (The greater the values, the poorer is the fastness.)

TABLE 3

| | | 100° C., 1 Week | | 60° C., 75% RH, 6 Weeks | |
|---|---|---|---|---|---|
| Sample | Compound | $D_{0.5}$ (%) | $D_{1.5}$ (%) | $D_{0.5}$ (%) | $D_{1.5}$ (%) |
| G* | DBP | 61 | 65 | 19 | 22 |
| H** | 10 | 40 | 42 | 7 | 8 |

*comparative example
**present invention

It is seen from the above results that, when used in a stratum structure system, the epoxy compound of the present invention provides good photographic properties and enables one to form color images with good moist heat stability. Similar results were obtained when Compound 1, 3 or 11 was used in place of Compound 10.

EXAMPLE 4

When the same tests as described in Example 1 were conducted using Cyan Coupler 2 (2-[α-(2,4-di-t-amylphenoxy)-acetamido]-4,6-dichloro-5-methylphenol) and Cyan Coupler 3 (2-tetradecanamido-4-chloro-5-methylphenol), the following results were obtained with respect to density reduction ratio.

TABLE 4

| | | Density Reduction after 1 Week at 100° C. | |
|---|---|---|---|
| Sample | Compounds Used | $D_{0.5}$ (%) | $D_{1.5}$ (%) |
| I* | Coupler 2, Compound 10 | 39 | 41 |
| J** | Coupler 2, DBP | 68 | 69 |
| K* | Coupler 3, Compound 10 | 34 | 31 |
| L** | Coupler 3, DBP | 40 | 38 |

*present invention
**comparative example

While the invention has been described in detail and with reference to specific embodiments thereof, it will be apparent to one skilled in the art that various changes and modifications can be made therein without departing from the spirit and scope thereof.

What is claimed is:

1. A process for forming a photographic light-sensitive material which comprises dissolving an oil-soluble photographic additive in an epoxy compound of the formula (II):

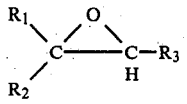

(II)

wherein $R_1$, $R_2$ and $R_3$ each represents an alkyl or a substituted alkyl group having 1 to 40 carbon atoms, an alkoxycarbonyl or substituted alkoxycarbonyl group having 1 to 40 carbon atoms or a hydrogen atom provided that at least one of $R_1$, $R_2$ and $R_3$ is an alkyl group substituted by an alkoxycarbonyl group, an aryloxycarbonyl group or an aryloxy group having 8 to 40 carbon atoms and the sum of the number of carbon atoms of $R_1$, $R_2$ and $R_3$ is 8 to 60.

2. The process of claim 1, wherein said oil-soluble photographic additive is a cyan coupler of general formula (III):

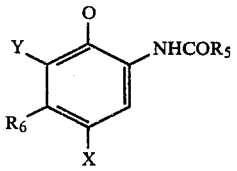

(III)

wherein $R_5$ represents a substituted or unsubstituted alkyl group containing 1 to 22 carbon atoms or a substituted or unsubstituted aryl group having 6 to 22 carbon atoms, $R_6$ represents a substituted or unsubstituted alkyl group containing 1 to 22 carbon atoms, an acylamino group or a hydrogen atom, X represents a group capable of being eliminated upon oxidative coupling with a developing agent or a hydrogen atom, Y represents a hydrogen atom or a hylogen atom, and one of $R_5$ and $R_6$ represents a ballast group containing 10 to 22 carbon atoms.

3. The process of claim 1, wherein the weight ratio of said epoxy compound of formula (II) to said cyan coupler of formula (III) is about 0.05 to 20.

4. The process of claim 3, wherein said cyan coupler dissolved in said epoxy compound is further dispersed in emulsion form in a hydrophilic colloid layer.

5. The process of claim 4, wherein said hydrophilic colloid is gelatin.

6. A silver halide light-sensitive photographic material containing at least one hydrophilic colloid layer containing an emulsion prepared by dissolving an oil-soluble cyan coupler represented by the formula (III):

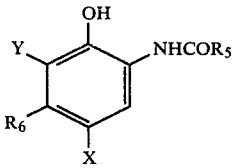

(III)

wherein $R_5$ represents a substituted or unsubstituted alkyl group containing 1 to 22 carbon atoms or a substituted or unsubstituted aryl group having 6 to 22 carbon atoms, $R_6$ represents a substituted or unsubstituted alkyl group containing 1 to 22 carbon atoms, an acylamino group or a hydrogen atom, X represents a group capable of being eliminated upon oxidative coupling with a developing agent or a hydrogen atom, Y represents a hydrogen atom or a hylogen atom, and one of $R_5$ and $R_6$ represents a ballast group containing 10 to 22 carbon atoms, in an epoxy compound represented by the formula (II):

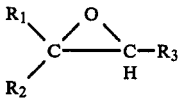

(II)

wherein $R_1$, $R_2$ and $R_3$ each represents an alkyl or a substituted alkyl group having 1 to 40 carbon atoms, an alkoxycarbonyl or substituted alkoxycarbonyl group having 1 to 40 carbon atoms, or a hydrogen atom provided that at least one of $R_1$, $R_2$ and $R_3$ is an alkyl group substituted by an alkoxycarbonyl group, an aryloxycarbonyl group or an aryloxy group having 8 to 40 carbon atoms and the sum of the number of carbon atoms of $R_1$, $R_2$ and $R_3$ is 8 to 60.

7. The photographic light-sensitive material of claim 6, wherein said epoxy compound is selected from the group

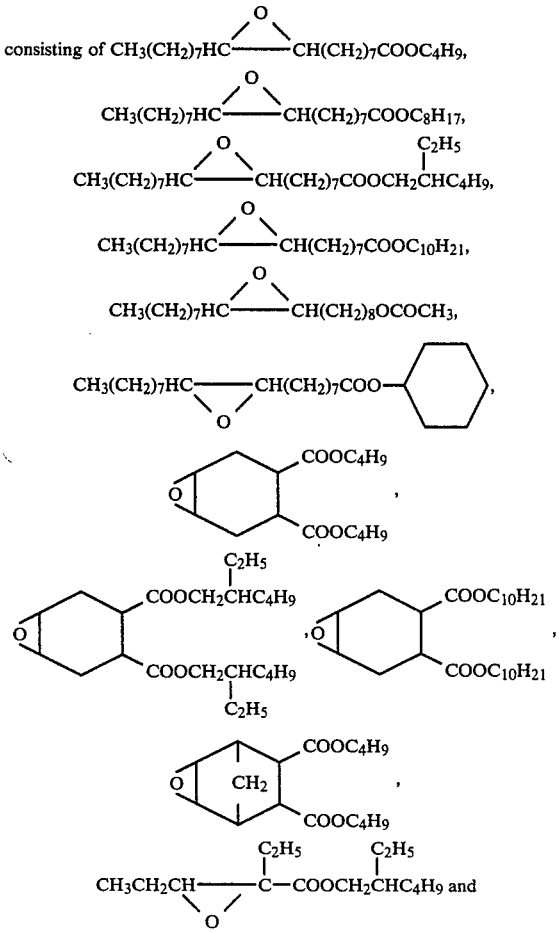

consisting of $CH_3(CH_2)_7HC(O)CH(CH_2)_7COOC_4H_9$,
$CH_3(CH_2)_7HC(O)CH(CH_2)_7COOC_8H_{17}$,
$CH_3(CH_2)_7HC(O)CH(CH_2)_7COOCH_2CH(C_2H_5)C_4H_9$,
$CH_3(CH_2)_7HC(O)CH(CH_2)_7COOC_{10}H_{21}$,
$CH_3(CH_2)_7HC(O)CH(CH_2)_8OCOCH_3$,
$CH_3(CH_2)_7HC(O)CH(CH_2)_7COO$-(cyclohexyl),
$COOC_4H_9$, $COOC_4H_9$,
$COOCH_2CH(C_2H_5)C_4H_9$, $COOCH_2CH(C_2H_5)C_4H_9$,
$COOC_{10}H_{21}$, $COOC_{10}H_{21}$,
$COOC_4H_9$, $CH_2$, $COOC_4H_9$,
$CH_3CH_2CH(O)C(C_2H_5)(C_2H_5)COOCH_2CHC_4H_9$ and -continued

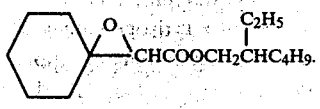

8. The photographic light-sensitive material of claim 6, wherein the weight ratio of said epoxy compound of the formula (II) to said cyan coupler of formula (III) is about 0.05 to 20.

9. The photographic light-sensitive material of claim 6, wherein said epoxy compound of the formula (II) has a boiling point higher than 200° C. at atmospheric pressure.

10. The photographic light-sensitive material of claim 6, where in addition to said epoxy compound another organic solvent conventionally used to disperse the cyan coupler in the hydrophilic colloid is present.

11. The photographic light-sensitive material of claim 6, wherein said hydrophilic colloid is gelatin.

* * * * *